US005744022A

United States Patent [19]

Miller

[11] Patent Number: 5,744,022

[45] Date of Patent: Apr. 28, 1998

[54] METHOD AND APPARATUS FOR PRODUCING SULFUR HEXAFLUORIDE

[76] Inventor: Jorge Miller, 3300 Sage Rd., Apt. 9204, Houston, Tex. 77056

[21] Appl. No.: 802,862

[22] Filed: Feb. 19, 1997

[51] Int. Cl.[6] ..... C25B 1/00

[52] U.S. Cl. ..... 205/554

[58] Field of Search ..... 205/554

[56] References Cited

U.S. PATENT DOCUMENTS

| | | | |
|---|---|---|---|
| 2,519,983 | 8/1950 | Simons | 205/554 |
| 2,717,235 | 9/1955 | Prober | 205/554 |
| 3,345,277 | 10/1967 | Ashley et al. | 205/554 |
| 3,623,964 | 11/1971 | Ukihashi et al. | 205/554 |
| 4,174,266 | 11/1979 | Jeffery | 205/554 |

OTHER PUBLICATIONS

"The Preparation of Sulfur Hexafluoride and Some of Its Physical Properties" *The Journal of the American Chemical Society*, vol. 52, pp. 4302–4308 (1930).

*Primary Examiner*—Arun S. Phasge
*Attorney, Agent, or Firm*—Browning Bushman

[57] ABSTRACT

The present invention is directed to an apparatus and methods for preparing sulfur hexafluoride within an electrolytic cell by reacting elemental sulfur with fluorine electrolytically generated from substantially anhydrous hydrogen fluoride in the presence of a conductivity-enhancing solute. The reaction occurs at the anode of the electrolytic cell in a liquid electrolyte comprising substantially anhydrous hydrogen fluoride and an alkali fluoride wherein the concentration of hydrogen fluoride is maintained between about 64 and about 88 mole percent. The electrolytic cell is preferably divided into a cathodic half-cell and an anodic half-cell by a non-conductive diaphragm which permits passage of the electrolyte and current to provide communication between the half-cells while being impervious to fluid communication above the electrolyte to keep the generated gases separate. When so divided, substantially pure sulfur hexafluoride may be recovered from the space above the electrolyte in the anodic half-cell. The present apparatus and methods provide significant energy savings in the manufacture of sulfur hexafluoride.

25 Claims, 1 Drawing Sheet

METHOD AND APPARATUS FOR PRODUCING SULFUR HEXAFLUORIDE

BACKGROUND OF THE INVENTION

I. Field of the Invention

The present invention generally relates to methods for preparing sulfur hexafluoride in an electrolytic cell. More specifically, the present invention is directed to methods and apparatus for safely and economically generating sulfur hexafluoride in an electrolytic cell by the reaction of elemental sulfur with fluorine generated in situ from substantially anhydrous hydrogen fluoride in the presence of a conductivity-enhancing solute.

II. Description of the Background

Sulfur hexafluoride ($SF_6$) is one of the most stable and inert gases known. Because of its chemical inertness, high dielectric constant and high molecular weight, sulfur hexafluoride has often been used as a gaseous insulator in high voltage generators and other electrical equipment.

The thermodynamic properties of sulfur hexafluoride indicate that it should also function as an excellent refrigerant gas. The fact that sulfur hexafluoride is also non-toxic provides another incentive to investigate its use as a refrigerant. Sulfur hexafluoride offers the possibility of a favorable alternative to the commonly used chlorofluorocarbon refrigerants, i.e., the Freon® gases, which have been implicated in the depletion of ozone in the stratosphere. Because sulfur hexafluoride is about five times more dense than air, any escaping refrigerant gas would remain near the surface of the earth. If, however, sulfur hexafluoride did reach the stratosphere, it would not react with the ozone layer, having no carbon to halogen bond. In fact, if sulfur hexafluoride in the stratosphere were bombarded with high speed particles or cosmic rays, it would decompose, producing fluorine which would react with water vapor to generate additional ozone, thus replenishing the ozone layer. Accordingly, sulfur hexafluoride could provide an environmentally friendly and beneficial refrigerant.

Unfortunately, the current cost of sulfur hexafluoride, about $10.00 per pound, prohibits its use as a refrigerant. This cost is so high because huge amounts of electrical power are consumed in the present manufacturing processes.

Sulfur hexafluoride is typically manufactured by the direct fluorination of sulfur vapor with pure, gaseous fluorine. The method still used for commercially generating fluorine is described in an article by Walter Schumb and Lee Gamble entitled "The Preparation of Sulfur Hexafluoride and Some of Its Physical Properties" published in the *Journal of the American Chemical Society,* Vol. 52 (1930) at pages 4302–4308. In the most common manufacturing process, gaseous fluorine generated in an electrolytic cell in accord with the method described in the *JACS* article is then reacted with sulfur to produce sulfur hexafluoride.

Fluorination may be performed directly in an electrolytic cell. In U.S. Pat. No. 2,519,983 Joseph Simons describes one of the first processes for fluorinating compounds within an electrolytic cell. The Simons patent describes a process for producing fluorine-containing carbon compounds in an electrolytic cell containing liquid hydrogen fluoride and an organic starting compound.

In U.S. Pat. No. 2,717,235 Maurice Prober describes the fluorination of sulfur compounds within an electrolytic cell. The Prober patent describes the manufacturing process most often used today. The Prober patent teaches that inorganic, covalent, sulfur compounds, e.g., hydrogen sulfide, carbon disulfide and sulfur monochloride, may be fluorinated in an electrolytic cell in the presence of liquid hydrogen fluoride. This reaction requires the input of significant electrical energy, about 417 KCal per mole of sulfur hexafluoride produced. Further, because the produced sulfur hexafluoride is mixed with an inert carrier gas and other gaseous by-products, more energy must be used to separate and purify the final product.

In summary, these prior methods for producing sulfur hexafluoride using pure, gaseous fluorine generated in an electrolytic cell to fluorinate inorganic, covalent sulfur compounds require the consumption of huge amounts of energy in the electrolytic production of fluorine and in its reaction with the covalently bonded sulfur compound. Still more energy is required to separate and purify the final product. Further, fluorine, because of its extremely high reactivity and toxicity, requires special safety procedures for handling. These procedures also may produce polluting and, in fact, toxic wastes.

Accordingly, there has been a long felt but unfulfilled need for more economical, more efficient, safer and less polluting methods for producing sulfur hexafluoride. The present invention solves those needs.

SUMMARY OF THE INVENTION

The present invention is directed to a process for producing sulfur hexafluoride in an electrolytic cell with insoluble electrodes. In a preferred embodiment of the present invention, finely ground elemental sulfur suspended in substantially anhydrous hydrogen fluoride is delivered to an electrolytic cell containing a liquid electrolyte comprising substantially anhydrous hydrogen fluoride and a conductivity-enhancing solute. Preferred conductivity-enhancing solutes are the alkali fluorides, particularly potassium fluoride, sodium fluoride and mixtures thereof. The concentration of hydrogen fluoride in the electrolyte is preferably maintained between about 64 and about 88 mole percent. Preferred operating temperatures are from about 0° C. to about 100° C. so that the electrolyte remains liquid. The most preferred operating temperature is about 75° C. By applying a voltage across the cell, preferably from about 5 volts to about 7 volts, fluorine will be generated for in situ reaction with the elemental sulfur to produce sulfur hexafluoride in the anodic half-cell of the electrolytic cell. This voltage, while sufficient to generate fluorine for reaction with the elemental sulfur, is insufficient to generate free fluorine in the cell. Thus, the produced gas is substantially pure sulfur hexafluoride and is free of fluorine gas contamination.

In a preferred apparatus and method for performing the present invention, the electrolytic cell is divided into a cathodic half-cell and an anodic half-cell by a non-conductive diaphragm placed between the cathode and the anode. This diaphragm should be impervious to fluids above the electrolyte level in order to maintain separation of the sulfur hexafluoride generated at the anode and hydrogen gas generated at the cathode. However, this diaphragm should be porous to fluid and current in the electrolyte in order to facilitate operation of the electrolytic cell.

Elemental sulfur is preferably provided in the form of a fine powder, most preferably a powder sufficiently small to pass through a 100 mesh filter. Such finely divided sulfur provides a greater surface area for reaction and remains in suspension better. While it is preferred that elemental sulfur be maintained in suspension by natural circulation of the electrolyte suspension about the anode, supplemental pumping may be employed, if necessary, to prevent precipitation of sulfur and fouling of the anode.

In another aspect of the present invention, a system for generating sulfur hexafluoride in accord with the foregoing method is provided. The system includes an insulated, electrolytic cell for holding the liquid electrolyte, together with at least a pair of insoluble electrodes comprising a cathode and an anode for connection to an electrical source to apply the required voltage across the cell. The electrodes used must be insoluble in the anhydrous hydrogen fluoride electrolyte. Those skilled in the art are aware of conventional electrodes which satisfy this requirement. Exemplary electrodes include graphite, nickel and nickel-clad electrodes.

Disposed within the cell and covering at least a portion of the electrodes is a liquid electrolyte comprising substantially anhydrous hydrogen fluoride and a conductivity-enhancing solute in accord with the characteristics described in the foregoing method of the present invention. The cell is separated into a cathodic half-cell and an anodic half-cell by a non-conductive diaphragm as described above. Finally, the system of the present invention includes a first conduit for delivering finely ground elemental sulfur suspended in substantially anhydrous hydrogen fluoride to the electrolytic cell and a second conduit for carrying away gaseous sulfur hexafluoride generated at the anode. In the preferred embodiment the diaphragm is comprised of an inert chlorofluorocarbon material, e.g., Teflon®, in the form of a solid diaphragm above the electrolyte level and a woven mesh below. Finally, the anode may include a pair of spaced apart openings therethrough, one above the other, provided to enhance circulation of the electrolyte and suspended sulfur about the anode and to assist in maintaining the sulfur in suspension.

Thus, the longfelt, but unfulfilled need for more economical, more efficient, less polluting and safer methods for manufacturing sulfur hexafluoride has been met. These and other meritorious features and advantages of the present invention will be more fully appreciated from the following description and claims.

BRIEF DESCRIPTION OF THE DRAWING

Other features and intended advantages of the present invention will be more readily apparent by the references to the following detailed description in connection with the accompanying drawing, wherein.

Figure 1:
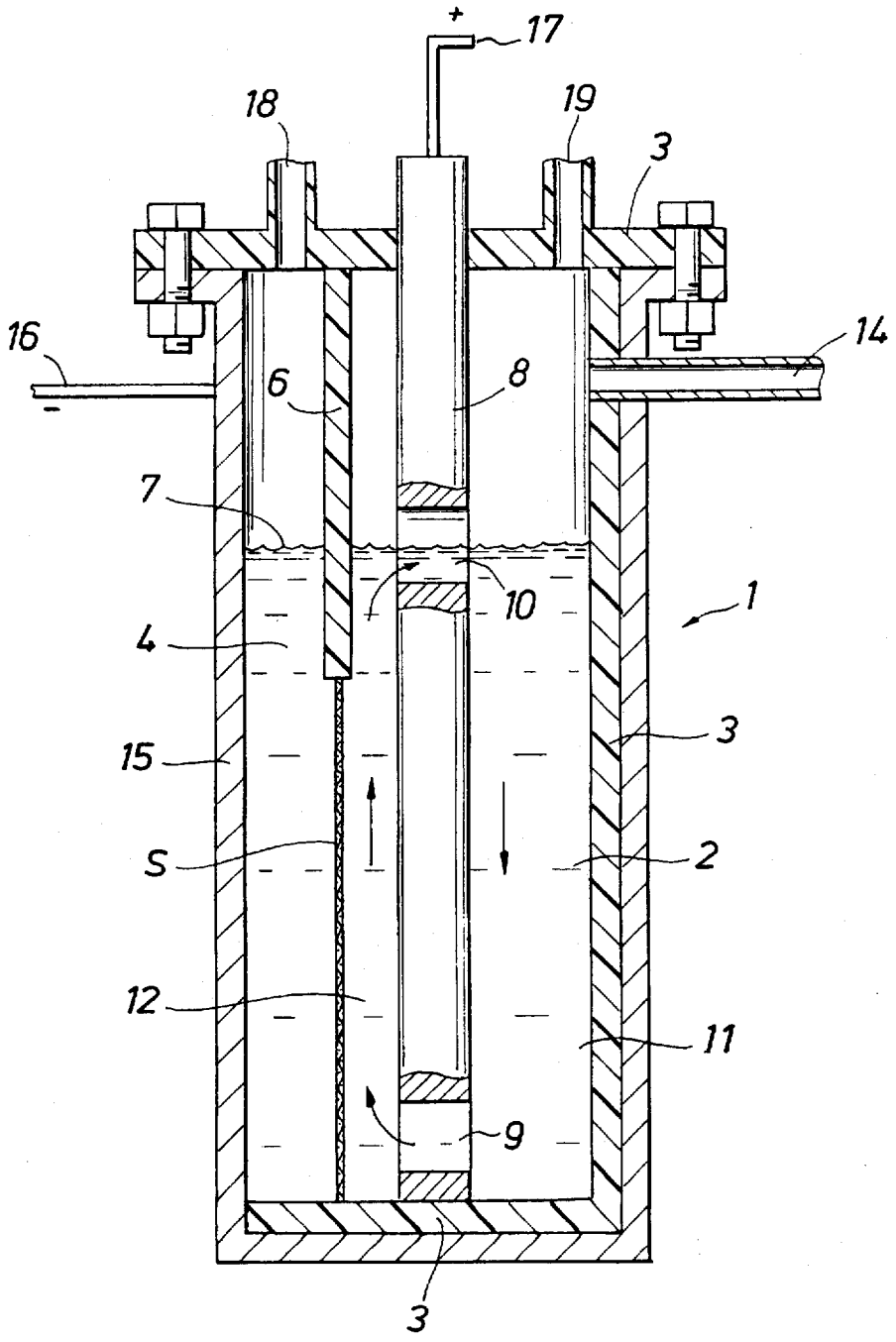
FIG. 1 is a cross-sectional illustration of an electrolytic cell in accord with the system of the present invention and useful for performing the method of the present invention.

While the invention will be described in connection with the presently preferred embodiments, it will be understood that it is not intended to limit the invention to those embodiments. On the contrary, it is intended to cover all alternatives, modifications and equivalents as may be included in the spirit of the invention as defined in the appended claims.

DETAILED DESCRIPTION OF THE PREFERRED EMBODIMENTS

The present invention provides improved, more efficient and more economical methods and apparatus for manufacturing sulfur hexafluoride. The process is directed to the electrolytic production of sulfur hexafluoride by the reaction of electrolytically generated fluorine with elemental sulfur suspended in a liquid electrolyte comprising substantially anhydrous hydrogen fluoride and a conductivity-enhancing solute in an electrolytic cell operated at a voltage sufficient to produce sulfur hexafluoride.

In the present invention, elemental sulfur is reacted in an electrolytic cell with fluorine generated from hydrogen fluoride by the following reaction:

$$S+3F_2 \rightarrow SF_6 \quad (1)$$

The heat of the reaction of elemental sulfur with fluorine is only 292 Kcal per mole of sulfur hexafluoride produced. In the method described in the Prober patent, hydrogen sulfide or another inorganic, covalent, sulfur compound is transported into the electrolytic cell in an inert gas where it reacts with fluorine to form sulfur hexafluoride and other compounds by way of the following reaction:

$$H_2S+4F_2 \rightarrow SF_6+2HF \quad (2)$$

The heat of this reaction, at the temperatures involved, is 417 Kcal per mole of sulfur hexafluoride produced. Accordingly, the reaction of the present invention requires about 125 Kcal per mole less energy, providing an energy savings of about thirty percent (30%) over the conventional method described in the Prober patent.

Energy consumption may be reduced by even more than this thirty percent (30%) saving using the methods of the present invention. Because less energy is required to produce sulfur hexafluoride by the reaction of equation (1) and significantly less heat is generated, the power required to refrigerate the electrolytic cell will be cut about in half. Further, in the prior art method disclosed by Prober, there is no diaphragm separating the anodic and cathodic half-cells of the electrolytic cell. Accordingly, the sulfur hexafluoride reaction product will be diluted not only with the inert carrier gas, but also with four moles of hydrogen for each mole of sulfur hexafluoride generated. The desired sulfur hexafluoride must be separated and purified not only from the inert carrier gas but also from generated hydrogen, thus further increasing the costs of manufacture.

The method of the present invention will be described in connection with the apparatus illustrated in FIG. 1 which is suitably adapted for performing the method of the present invention. Electrolytic cell 1 comprises nickel-coated metal divided into two half-cells. Anodic half-cell 2 is coated with a chlorofluorocarbon material, preferably Teflon®, and is separated from cathodic half-cell 4 by means of a diaphragm. The diaphragm comprises lower portion 5 preferably formed of a fine, porous, woven Teflon® material which permits the passage of electrolyte and current between anodic half-cell 2 and cathodic half-cell 4. To prevent the passage of gases formed at the electrodes and accumulated above the electrolyte, upper portion 6 of the diaphragm must be solid and must extend below the surface level of electrolyte 7.

In the illustrated embodiment, anode 8 comprises a square graphite, nickel or nickel-clad electrode. In the most preferred embodiment, anode 8 includes one or more holes 9 near the bottom thereof and one or more holes 10 near the electrolyte surface. Anode 8 is separated from the wall of anodic half-cell 2 by a minimum of about 2 cm. forming space 11 therebetween. The other side of anode 8 is separated at least 1 cm. from diaphragm 6 forming space 12. Spaces 11 and 12, together with holes 9 and 10 through anode 8, combine together to facilitate circulation of the electrolyte about anode 8 when gas bubbles are produced in space 12 during electrolysis. The liquid in space 12, together with gas produced therein, is less dense than the liquid in space 11 and a flow is established between spaces. The circulation path is indicated by the arrows in the drawing. This circulation assists in preventing sulfur particles from settling to the bottom of anodic half-cell 2 and permitting the accumulation of free fluorine in the product.

Port 14 provides fluid communication with a source of reactants, i.e., ground sulfur suspended in liquid, substantially anhydrous, hydrogen fluoride. This suspension of reactants is continuously or intermittently fed through port 14 to anodic half-cell 2 in order to maintain the level of electrolyte 7 in cell 1. The electrolyte comprises from about 64 to about 88 mole percent hydrogen fluoride, together with an alkali metal fluoride, most preferably potassium fluoride, and is maintained in a liquid state in the cell, preferably at temperatures between about 0° C. and about 100° C.

A review of the literature indicates that mixtures of substantially anhydrous hydrogen fluoride and potassium fluoride melt at temperatures from about 0° C. to about 100° C. as the concentration of hydrogen fluoride decreases from about 88 to about 64 mole percent. This temperature range is also the range predicted by thermodynamics to produce the least amount of undesirable sulfur fluoride by-products and, accordingly, establishes the desired operating temperature range. It is believed that the optimal operating conditions will be achieved at a temperature of about 75° C. with an electrolyte comprising from about 64 to about 88 mole percent hydrogen fluoride.

Sulfur, having a density of about 2, is preferably ground to a fine powder before being suspended in the liquid hydrogen fluoride and introduced to the electrolytic cell. Most preferably, the sulfur has been ground so that it will pass through a 100 mesh Tyler standard screen. Sulfur of this particle size is easier to maintain in suspension and provides greater surface area for reaction with the electrolytically generated fluorine.

Sulfur particles of this size will have a terminal settling velocity in substantially anhydrous hydrogen fluoride of about 0.03 feet per second. This means that gas bubble production in space 12 should be established to produce a net upflow in space 12 of at least about 0.03 feet per second, preferably about 0.04 feet per second or greater. An electrode 1 m. square, disposed 1 cm. from diaphragm 6 and immersed in the described electrolyte with a current flow of about 1500 amp will produce an upflow of between 1 and 3 feet per second depending on pressure, density and temperature of the liquid electrolyte. Thus, sufficient velocity is produced to cause vigorous circulation without requiring the assistance of a supplemental pump.

The efficiency of the present methods and apparatus for generating sulfur hexafluoride by fluorinating elemental sulfur instead of inorganic, covalent, sulfur compounds requires that the sulfur be maintained in suspension so that it may quickly and efficiently react with the electrolytically generated fluorine. If sulfur is not maintained in suspension, sulfur settling from the electrolyte will rapidly accumulate at the bottom of the electrolytic cell, clogging the cell and resulting in the production of a mixture of sulfur hexafluoride and fluorine. Accordingly, if circulation within the anodic half-cell is insufficient to maintain the elemental sulfur in solution, a supplemental, recirculation pump should be employed.

Anode 8 is connected to the positive current source through connector 17. The cell will normally be operated at a voltage between about 5 volts and about 7 volts and a current of about 1500 amp depending on conductivity and distance between electrodes. This voltage is sufficient to generate fluorine to produce sulfur hexafluoride but insufficient to produce free fluorine in the anodic half-cell. Sulfur hexafluoride produced in anodic half-cell 2 is accumulated above the electrolyte and led through port 19 to conventional hydrofluoric acid recovery and sulfur hexafluoride purification systems (not shown). Both recovery and purification systems are well known to those skilled in the art and include conventional high-pressure condensation of hydrofluoric acid. Exemplary systems are illustrated and described in U.S. Pat. Nos. 2,519,983 and 2,717,235, previously discussed and incorporated herein by reference.

The cathode is provided by wall 15 of cathodic half-cell 4. Connection to the negative current source is through connector 16. Hydrogen generated in the cathodic half-cell 4 is accumulated above the electrolyte and led through port 18 to a conventional hydrofluoric acid recovery system (not shown).

Cooling of electrolytic cell 1 may be accomplished by internal cooling coils or through the walls of the cell by any conventional system. Because cooling systems are well known to those skilled in the art, they have not been illustrated in the drawing. Exemplary systems are illustrated in the patents referenced above.

The foregoing description has been directed in primary part to a particular preferred embodiment in accordance with the requirements of the Patent Statutes and for purposes of explanation and illustration. It will be apparent, however, to those skilled in the art that many modifications and changes in the specifically described methods and apparatus may be made without departing from the true scope and spirit of the invention. For example, while potassium fluoride is the preferred conductivity-enhancing solute, any acceptable, non-interfering solute, e.g., an alkaline earth fluoride, which enhances conductivity may be used. Therefore, the invention is not restricted to the preferred embodiment described and illustrated but covers all modifications which may fall within the scope of the following claims.

What is claimed is:

1. A method of preparing sulphur hexafluoride in an electrolytic cell with insoluble electrodes, comprising:

suspending finely ground elemental sulphur in a liquid electrolyte maintained in an electrolytic cell and comprising substantially anhydrous hydrogen fluoride and a conductivity-enhancing solute selected from the group consisting of potassium fluoride, sodium fluoride and mixtures thereof, dividng said electrolytic cell into a cathodic half-cell and an anodic half-cell by disposing a non-conductive diaphragm between a pair of insoluble electrodes comprising a cathode and an anode, said diaphragm comprising a solid fluid-impermeable upper portion separating said half-cells above said electrolyte and extending below said electrolyte to prevent mixing of gases formed at said electrodes and a woven, mesh lower portion which is permeable to said electrolyte and to current passing between said half-cells;

applying to said electrodes a cell voltage sufficient to produce sulphur hexafluoride;

circulating said electrolyte and elemental sulphur around said anode in said anodic half-cell by locating a pair of passageways through said anode said passageways spaced along said anode with a first passageway disposed through said anode at a location near the bottom of said cell and a second passageway disposed through said anode at a location near the surface of said electrolyte; and generating sufficient gas bubbles on said anode to maintain said elemental sulphur suspended in said electrolyte and to cause natural circulation around said anode and through said passageways.

2. The method of claim 1, further comprising maintaining the concentration of hydrogen fluoride in said electrolyte between about 64 and about 88 mole percent.

3. The method of claim 2, further comprising maintaining the temperature of said electrolyte between about 0° C. and about 100° C.

4. The method of claim 2, further comprising replenishing said hydrogen fluoride and elemental sulfur by delivering to said electrolytic cell a flow of substantially anhydrous hydrogen fluoride with said elemental sulfur suspended therein.

5. The method of claim 1 wherein said diaphragm comprises a fluorocarbon polymer.

6. A method of preparing sulphur hexafluoride in an electrolytic cell with insoluble electrodes, comprising:

contacting elemental sulphur with an electrolyte comprising substantially anhydrous hydrogen fluoride and a conductivity enhancing solute, said electrolyte maintained in a liquid state in an electrolytic cell having a pair of insoluble electrodes comprising a cathode and an anode;

disposing a non-conductive diaphragm between said cathode and anode to divide said electrolytic cell into a cathodic half-cell and an anodic half-cell, said diaphragm comprising a solid, fluid-impermeable upper portion separating said half-cells above said electrolyte and extending below said electrolyte to prevent mixing of gases formed at said electrodes and a woven, mesh lower portion which is permeable to said electrolyte and to current passing between said half-cells; and applying a cell voltage across said insoluble electrodes, said voltage sufficient to produce sulphur hexafluoride.

7. The method of claim 6, further comprising circulating said electrolyte and elemental sulphur around said anode in said anodic half-cell.

8. The method of claim 7 wherein said circulating is achieved by pumping.

9. The method of claim 7 wherein said circulating is achieved by locating a pair of passageways through said anode, said passageways spaced along said anode with a first passageway located in said anode near the bottom of said cell and a second passageway located in said anode near the surface of said electrolyte, and generating sufficient gas bubbles on said anode to maintain said elemental sulphur suspended in said electrolyte and to cause natural circulation around said anode.

10. The method of claim 5, further comprising maintaining from about 64 to about 88 mole percent hydrogen fluoride in said electrolyte.

11. The method of claim 10 further comprising maintaining the temperature of said electrolyte between about 0° C. and about 100° C.

12. The method of claim 5 wherein said conductivity-enhancing solute is an alkali fluoride.

13. The method of claim 12 wherein said conductivity-enhancing solute is selected from the group consisting of potassium fluoride, sodium fluoride and mixtures thereof.

14. The method of claim 12 further comprising maintaining the temperature of said electrolyte at about 75° C.

15. The method of claim 5 wherein said elemental sulphur is suspended in said electrolyte.

16. The method of claim 15 further comprising providing said elemental sulphur as a fine powder.

17. The method of claim 16 wherein said elemental sulphur is sufficiently small to pass through a 100 mesh filter.

18. The method of claim 5 comprising applying a voltage of about 5–7 volts across said cathode and anode.

19. The method of claim 5 wherein said cell voltage is insufficient to produce free fluorine in said electrolytic cell.

20. The method of claim 6 wherein said diaphragm comprises a fluorocarbon polymer.

21. A system for generating sulphur hexafluoride, comprising:

an insulated, electrolytic cell for holding an electrolyte;

a pair of insoluble electrodes comprising a cathode and an anode for connection to an electrical source to apply a cell voltage across said cell;

an electrolyte disposed in said cell and into which said electrodes are immersed, said electrolyte maintained in a liquid state and comprising substantially anhydrous hydrogen fluoride and a conductivity-enhancing solute;

a non-conductive diaphragm separating said cell into a cathodic half-cell and an anodic half-cell, said diaphragm comprising a solid fluid-impermeable upper portion separating said half-cells above said electrolyte and extending below said electrolyte to prevent mixing of gases formed at said electrodes and a woven, mesh lower portion which is permeable to said electrolyte and to current passing between said half-cells;

a first conduit for delivering finely ground elemental sulphur suspended in substantially anhydrous hydrogen fluoride into said electrolytic cell; and a second conduit for carrying away gaseous sulphur hexafluoride generated at said anode from above said electrolyte in said anodic half-cell.

22. The apparatus of claim 21 wherein said diaphragm is comprised of a fluorocarbon polymer.

23. The apparatus of claim 21 wherein said electrodes are selected from the group consisting of graphite, nickel, and nickel-clad electrodes.

24. The apparatus of claim 21 wherein said anode includes a pair of openings spaced along said anode with a first opening passing through said anode at a location just below the surface of said electrolyte and a second opening passing through said anode near the end of said anode disposed within said electrolyte to facilitate circulation of said electrolyte and suspended elemental sulfur about said anode.

25. The apparatus of claim 21 wherein said conductivity-enhancing solute is selected from the group consisting of potassium fluoride, sodium fluoride and mixtures thereof and said electrolyte comprises from about 64 to about 88 mole percent hydrogen fluoride.

* * * * *